United States Patent [19]

Pamplin et al.

[11] Patent Number: 4,644,769

[45] Date of Patent: Feb. 24, 1987

[54] WIRE DRAWING METHOD AND APPARATUS

[75] Inventors: John W. Pamplin, Hansterley; Brian R. Astbury, Witton-le-Wear, both of United Kingdom

[73] Assignee: Marshall Richards Barcro Limited, Crook, United Kingdom

[21] Appl. No.: 883,867

[22] Filed: Jul. 14, 1986

Related U.S. Application Data

[63] Continuation of Ser. No. 662,350, Oct. 18, 1984, abandoned.

[30] Foreign Application Priority Data

Oct. 28, 1983 [GB] United Kingdom ..... 8328843

[51] Int. Cl.[4] ..... B21C 9/00; B21C 1/12; B21C 1/14

[52] U.S. Cl. ..... 72/43; 72/39; 72/280; 72/281; 72/286; 72/289

[58] Field of Search ..... 72/43, 39, 45, 281, 72/280, 282, 286, 289

[56] References Cited

U.S. PATENT DOCUMENTS

| | | | |
|---|---|---|---|
| 617,053 | 1/1899 | Scheel | 72/280 |
| 796,261 | 8/1905 | Smith | 72/280 |
| 824,655 | 6/1906 | Horton | 72/289 |
| 1,178,331 | 4/1916 | Marvin | 72/280 |
| 1,529,713 | 3/1925 | Picotin | 72/286 |
| 1,865,781 | 7/1932 | Najarian | 72/280 |
| 1,948,664 | 2/1934 | Johnson | 72/43 |
| 2,024,769 | 12/1935 | Johnson | 72/286 |
| 2,237,371 | 4/1941 | Simons | 72/289 |
| 3,402,587 | 9/1968 | Lawler . | |
| 3,595,045 | 7/1971 | Fuqua . | |
| 3,774,436 | 11/1973 | Tviksta | 72/286 |
| 4,094,180 | 6/1978 | Griffiths | 72/281 |
| 4,345,451 | 8/1982 | Pamplin et al. | 72/286 |
| 4,464,922 | 8/1984 | Pamplin et al. | 72/286 |

FOREIGN PATENT DOCUMENTS

| | | | |
|---|---|---|---|
| 0053636 | 6/1982 | European Pat. Off. . | |
| 560001 | 9/1932 | Fed. Rep. of Germany . | |
| 450089 | 3/1913 | France | 72/289 |
| 1181963 | 6/1959 | France | 72/289 |
| 2038219 | 7/1980 | United Kingdom . | |
| 2049519 | 12/1980 | United Kingdom . | |
| 2050902 | 1/1981 | United Kingdom | 72/286 |
| 2082105 | 3/1982 | United Kingdom . | |

*Primary Examiner*—Daniel C. Crane

*Attorney, Agent, or Firm*—Prutzman, Kalb, Chilton & Alix

[57] ABSTRACT

A multi-stage steel wire drawing machine has, in each stage, two dies and a single drive motor for drawing the wire through the two dies. In a preferred arrangement the dies are mounted side-by-side and an idler wheel used to define part of the wire path between the dies in the stage and a coaxial driven wheel is used to draw the wire through both dies in the stage and to define part of the wire path leading to the next stage. Dry wire lubrication before die entry and water cooling after passage through the dies are disclosed.

8 Claims, 4 Drawing Figures

WIRE DRAWING METHOD AND APPARATUS

This is a continuation of co-pending application Ser. No. 662,350 filed on Oct. 18, 1984 now abandoned.

BACKGROUND OF THE INVENTION

1. Field of the Invention

The invention relates to an improved method of, and apparatus for, drawing wire, in particular ferrous wire, which is an extension of the techniques described in the specifications of U.S. Pat. Nos. 4,345,451 and 4,464,922.

The term "wire" as used in this specification is not intended to be limited to material of circular cross-section since the invention extends to any ductile metallic material of solid cross-section irrespective of its cross-sectional shape.

2. Discussion of Prior Art

In the above-mentioned patent specifications, wire-drawing methods are disclosed which involve the use of a driven wire-engaging drawing wheel to generate the necessary drafting tension for drawing wire through a die, the wire being wrapped around the wheel for less than one complete turn or for a few turns plus less than one complete turn and being directly contacted by a liquid coolant after leaving the die and while wrapped around the drawing wheel.

The methods described in the above-mentioned patent specifications have given excellent results, particularly with regard to the properties of the drawn wire (e.g. ductility as measured by conventional tensile, torsion and/or bend tests) and it is felt these improved properties are, in part, a consequence of an overcoming of the cooling restrictions typical with conventional machines even when the reduction of cross-sectional area of the wire effected at the sizing orifice in a die in a patented apparatus is considerably in excess of what is customary with conventional machines. However when employing these large reductions of cross-sectional area (which can exceed some 40% per die) it has been found that die wear can increase to an unacceptable degree. Nevertheless, apart from this disadvantage of reduced die life, very satisfactory wire can be produced with such large area reductions, and operating the method in this way does not result in wire breakage due to the very high drafting tensions required.

Clearly one solution to the problem of excessive die wear is to increase the number of drawing stages to obtain the desired overall reduction of cross-sectional area with a smaller reduction of area per stage. This is a solution which significantly increases the cost of a machine since the electrical equipment to drive and control the speed of each drawing wheel is expensive. Furthermore increasing the number of drawing stages requires a larger floor area to accommodate the machine.

SUMMARY OF THE INVENTION

This invention relates to a method and apparatus by which each drawing stage includes some direct liquid coolant cooling of the wire after drawing in each stage but includes two separate areal reductions per stage.

According to one aspect of the invention, a method of reducing the cross-sectional area of a wire comprises driving a wire-engaging drawing wheel adjacent to a pair of dies, a second of which has a sizing orifice of smaller cross-sectional area than the sizing orifice of the first thereof, drawing the wire sequentially through the first die and then through the second die by means of drafting tension generated in the wire by frictional engagement of the wire in at least a part turn around the drawing wheel and directly contacting the wire, at least in its passage from the sizing orifice of the second die to the wheel and while the wire is in contact with the drawing wheel, with a liquid coolant.

The first and second dies can be mounted in series, with the second downstream of the first in the wire movement direction, the drawing wheel being downstream of the second die. This arrangement is convenient where the heat generated in the first die is at such a level that direct liquid cooling of the wire leaving the first die can be dispensed with. Lubrication of the wire prior to entry into the first die can be effected in the usual manner by drawing dry wire through a soap box upstream of the first die. Mid-die lubrication would be provided by a second soap box disposed between the dies, but the wire may be entering this second soap box at an elevated temperature and this would have to be borne in mind in the selection of the lubricant powder used in the second soap box. In theory it would be possible to cool the wire by direct liquid coolant contact therewith between the first die and the second soap box but in the case of the series in-line arrangement being discussed this is hardly practicable with the relatively short wire path likely to be available between the downstream end of the first die and the upstream end of the second soap box.

Downstream of the second die, the wire can be surrounded by a flowing jet of liquid coolant in the manner described in the aforementioned patent specifications and such a flowing jet can be trapped around at least a part of the periphery of the drawing wheel also as described in the prior patent documents.

The drawing wheel can have a V-groove to trap just a part of one turn or a U-groove to permit a few turns to be engaged therein.

An alternative arrangement (generally preferred where a substantial areal reduction occurs in each of the two dies) is to mount the dies side-by-side and to use a pair of drawing wheels, a driven one disposed to receive wire from the second die and a coaxial idler wheel disposed to receive wire from the first die and forward it on to the inlet of the second die. To reduce the tension in the wire leaving the second die it may be desirable to provide some form of slip coupling between the pair of drawing wheels in each stage so that some torque to assist in drawing wire through the first die is transmitted to the idler wheel from the driven wheel.

This side-by-side arrangement has the advantages of greater compactness and easily allows direct liquid cooling of wire leaving each die. Air wipes of known design can be used to dry the wire between the first and second dies of each stage and also between stages, so that liquid coolant is prevented from entering the upstream soap box of any die.

According to a further aspect of the invention, wire drawing apparatus comprises at least one drawing stage comprising first and second die boxes disposed one after the other along a wire path through the stage, a drawing wheel downstream of the second die box having a wire-engaging peripheral surface around which at least a part turn of wire can be frictionally engaged, a motor for rotating the drawing wheel in the direction to draw wire engaged on its peripheral surface through both the first and second die boxes, liquid coolant supply means to feed liquid coolant to wire leaving at least the second die box, coolant trap means to hold coolant against the peripheral surface of the drawing wheel, and wire drying means on the wire path downstream of the drawing wheel.

The die boxes can be located side-by-side and can be combined with a single soap box serving both dies. An idler wheel can be mounted coaxially with the drawing wheel and this is a particularly preferred arragement where some form of slip coupling is provided between the driven and idler wheels. With the coaxial wheel arrangement, a die located in the first die box can have a first die orifice which is of a cross-sectional area greater than that of a second die orifice in a second die located in the second die box, and the second die orifice can be aligned with the peripheral surface of the driven drawing wheel and the first die orifice can be aligned with the peripheral surface of the idler wheel. Both the driven wheel and the idler wheel can be contacted with flows of liquid coolant and suitably a common arcuate shroud confronts the peripheral surface of each wheel to hold a reservoir of coolant against the peripheral surface of each wheel.

BRIEF DESCRIPTION OF THE DRAWINGS

The invention will now be further described, by way of example, with reference to the accompanying drawings, in which.

DESCRIPTION OF PREFERRED EMBODIMENTS

Figure 1:
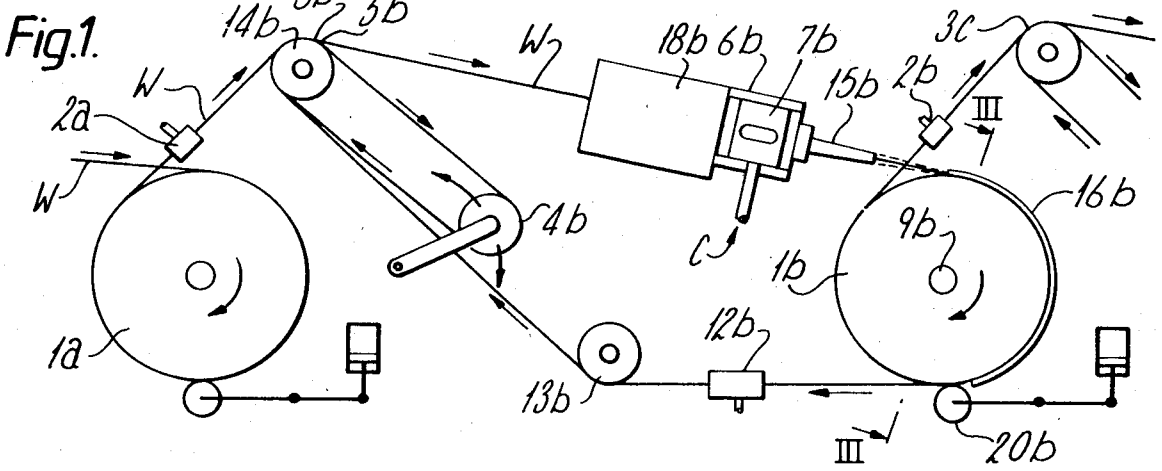
FIG. 1 is a side elevation of the main components of one stage of one embodiment of wire drawing apparatus according to the invention.
Figure 2:
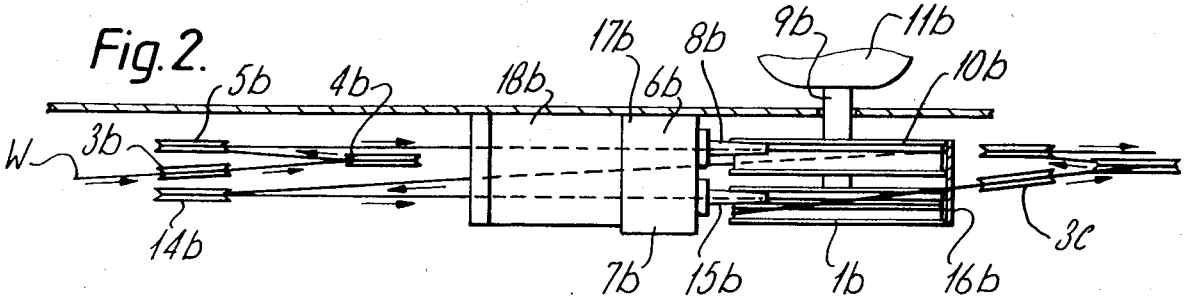
FIG. 2 is a plan from above the stage components shown in FIG. 1.
Figure 4:
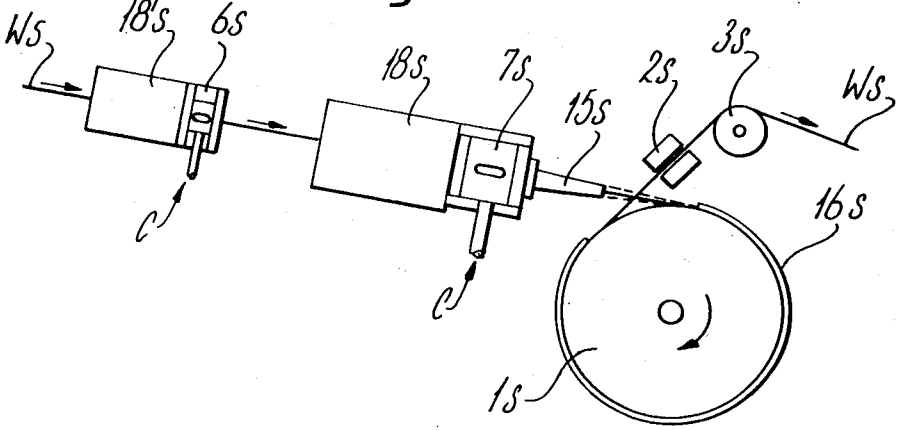
FIG. 4 is a schematic view of one stage of an alternative form of wire drawing apparatus according to the invention.

FIGS. 1 and 2 show the wire path of one stage of a wire drawing apparatus, wire W leaving a wheel 1*a* of an upstream stage passes through an air wipe 2*a* around a first transfer pulley 3*b*, a dancer pulley 4*b* and a second transfer pulley 5*b* before entering the first of the two liquid-cooled dies 6*b* and 7*b* of the stage. The wire W emerges from the first die 6*b*, passes through a cooling tube 8*b* (through which liquid coolant flows during drawing) and around a free running idler wheel 10*b* mounted on a drive shaft 9*b* of a stage motor 11*b*. After passing around the idler wheel 10*b* for the desired distance to achieve satisfactory liquid cooling (i.e. ½ turn, 1½ turns, 2½ turns etc.) the wire W is dried by an air wipe 12*b* and guided by two transfer pulleys 13*b*, 14*b* before it enters the second die 7*b* which is also conduction cooled by heat transmission from the die to liquid coolant circulating in passages in the block containing the die. The coolant inlets in FIGS. 1 and 4 are shown by the arrows C. Emerging again through a cooling tube 15*b* (again flooded with liquid coolant during drawing), the wire passes around the driven wheel 1*b* which provides the tractive pull for the reductions of area effected in each die. This wheel 1*b* may be either a V-grooved wheel as described in the first-noted patent specification referred to above (in which case less than one turn of wire is necessary for traction) or a flanged capstan block (or U-grooved wheel) as described in the second-noted patent specification referred to above (where more than one turn is used). After leaving the wheel 1*b*, the wire W is dried by an air wipe 2*b* and passes to a transfer pulley 3*c* of the next stage of the apparatus. The idler and driven wheels 10*b* and 1*b* are surrounded by a common shroud 16*b* to retain the liquid coolant (e.g. water) in contact with the wire. The shroud 16*b* is axially movable (in the directions of the arrows M in FIG. 3) on support rods 19*b*, to give access to the wheels 1*b* and 10*b* for threading. When the apparatus is threaded a die holder 17*b*, loaded with the two dies 6*b* and 7*b* is slid halfway across the outlet of a composite soap box 18*b* so that the first die 6*b* is in line with the driven wheel 1*b*. A pulling-in dog (not shown) is attached to a pointed end formed on the wire W in the normal manner and sufficient wire is drawn through the die 6*b* to extend around the wire path to the second die 7*b*. The drawn wire is then moved from the driven wheel 1*b* to the idler wheel 10*b*, the die holder 17*b* is pushed into its running position to align each of the two dies 6*b*, 7*b* with its appropriate wheel 10*b*, 1*b* and the pulling in procedure is repeated, this time drawing wire through the die 7*b*. During the threading operation a pressure roller (shown at 20*b* in FIG. 1), in the case of the V-grooved wheel, or a pressure pad (not shown), in the case of the U-grooved capstan is used as required to prevent the turn or turns of wire from springing away from the respective wheel e.g. while the pulling-in dog is being removed.

In many instances it is quite acceptable to have all the tension for drawing the wire through both of the dies 7*b*, 6*b*, generated by the driven wheel 1*b*. However, should this result in the wire tension leaving die 7*b* coming too close to the breaking strain of the wire, the situation can be alleviated by transmitting some drive to the wheel 10*b*. This can be achieved by locating an annular friction pad between the two wheels (e.g. as shown at 21 in FIG. 3) so that a slip coupling is provided between the two wheels.

Figure 3:
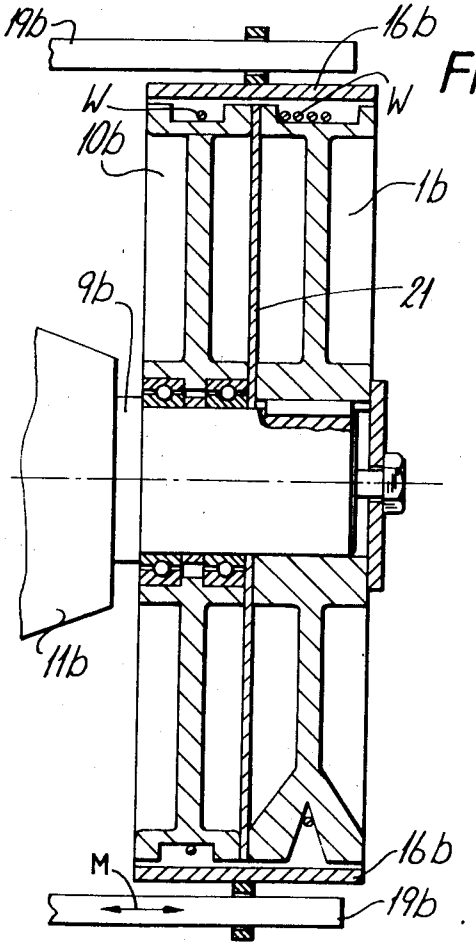
FIG. 3 is a view on the line III—III of the driven and idler wheels of the stage shown in FIG. 1 with the upper half of the driven wheel supporting a U-groove and the lower half thereof illustrating the use of a V-groove.

The configuration described with reference to FIGS. 1 to 3 is a preferred arrangement, but if direct liquid cooling of the wire exiting from the first die 6*b* is considered unimportant, as may be the case when drawing mild steel wire, then a simpler arrangement such as shown in FIG. 4 may be used.

In FIG. 4, in which similar reference numerals but with the addition of an "s" have been used to designate items similar to those in FIGS. 1 to 3, a single driven V- or U-grooved wheel 1*s* receives wire Ws from a cooling tube 15*s* as it leaves a second die 7*s*. A soap box 18*s* upstream of the die 7*s* receives the wire from a first die 6*s* downstream of a further soap box 18'*s*. Each die 6*s*, 7*s* may, and preferably would be, cooled by circulating a liquid through flow passages formed in the die. Coolant liquid is supplied to the cooling tube 15*s* and a shroud 16*s* partially surrounds the wheel 1*s* to trap coolant against it and in particular, below the wire, if a V-grooved wheel 1*s* is being used.

After leaving the wheel 1*s*, the wire Ws is dried in an air wipe 2*s* and led via a pulley 3*s* to the soap box of the first die of the next following stage (not shown).

It will be seen therefore that the arrangement shown in FIG. 4 is similar to that described in the aforementioned patent specifications with the addition of a second soap box and die holder in tandem with the first. The one driven traction wheel 1*s* generates the drafting tension necessary to pull the wire Ws through both dies in the stage.

It is considered that the apparatus described with reference to FIGS. 1, 2 and 3 has applications in drawing the full carbon range of steel wires where the reduction it can achieve at each drive motor is greater than that which is currently achievable with conventional machines.

Using a two stage, four die prototype machine in accordance with this invention, tests have been carried out on 0.06 C mild steel and 0.62 C steel which by repassing once through the prototype machine have allowed an eight die draft to be completed.

In the case of the mild steel from both 6.5 and 5.5 mm inlet materials equal 25% area reductions at all dies have been achieved which compounds to an overall reduction of 43.75% per stage and 68.36% per pass through the two stages of the prototype machine.

Experience with the 0.62 C steel wire leads us to believe that typically, from a 5.5 mm diameter inlet material 2.0 mm diameter outlet material can be produced in a machine comprising four stages and eight dies in total. In this case the draft per die would taper from 25.10% at the first die to 19.56% at the eighth die. The overall reduction per stage would have a corresponding taper of from 43.07% at the first stage to 36% at the fourth stage. In order to achieve a finishing speed of the order of 15 m/s each of the drive motors for the four stages would be of the order of 85 Kw.

The apparatus shown in FIGS. 1 and 4 is capable of significant modifications and all such modifications within the scope of the following claims should be considered as being within the spirit and scope of this invention.

What is claimed is:

1. In a multi-stage wire drawing machine, a single-stage wire drawing apparatus defining a wire path therethrough comprising, first and second dies serially positioned along said wire path with said second die being downstream of said first die, said first die having an orifice of a first predetermined cross-sectional area and said second die having an orifice of a second predetermined cross-sectional area less than said first predetermined cross-sectional area of said first die, a drawing wheel downstream of said second die to provide substantially the entire drawing tension for drawing wire through both the first and second dies, said drawing wheel having a wire-engaging peripheral surface around which at least a part turn of wire is frictionally engaged, motor means for rotating the drawing wheel in the direction to draw wire engaged on its peripheral surface through the first and second dies, means for directing wire along the wire path between the first die and the second die, said directing means comprising a rotatable idler wheel adapted to engage wire and be rotatably driven thereby, first liquid coolant supply means for feeding liquid coolant directly to wire leaving the orifice of the first die, lubricating means for applying lubricant to wire as it enters the orifice of the second die, wire drying means intermediate the first liquid coolant supply means and the lubricating means for removing liquid coolant from wire before it reaches the lubricating means, second liquid coolant supply means for feeding liquid coolant directly to wire leaving the second orifice in the second die and coolant trap means to hold coolant against the peripheral surface of the drawing wheel.

2. The apparatus of claim 1, wherein said first and second dies are disposed side-by-side and said idler wheel is mounted coaxially with said drawing wheel, said orifice of said second die being aligned with the peripheral surface of said drawing wheel, and said idler wheel having a peripheral surface contacted by the wire with said orifice of said first die being aligned with said peripheral surface of said idler wheel.

3. The apparatus of claim 2 which comprises means for contacting the wire leaving the orifices of said first and second dies with liquid coolant and a common shroud confronting the peripheral surfaces of said idler wheel and said drawing wheel to retain coolant against the wire engaged on the peripheral surfaces of said idler wheel and said drawing wheel.

4. The apparatus of claim 1 which comprises second lubricating means for applying lubricant to wire as it enters the orifice of the first die.

5. A method of reducing the cross-sectional area of a wire at a single stage of a multi-stage wire drawing system comprising the steps of:

lubricating the wire prior to drawing the wire through a first die, drawing the lubricant wire through a wire sizing orifice of a first die wherein the orifice is of a predetermined cross-sectional area, cooling the wire directly with flows of liquid coolant as it passes from the first die, directing the wire along a return path from the downstream end of the first die to the upstream end of a second die without significant increase in tension, removing liquid coolant from the wire passing along the return path and thereafter relubricating the wire prior to passing through the second die, drawing the relubricated wire through the wire sizing orifice of the second die wherein the orifice is of a predetermined cross-sectional area less than the cross-sectional area of the wire sizing orifice of said first die, cooling the wire directly with flows of liquid coolant as it passes from the second die, wrapping at least a part turn of wire around a drawing wheel, and drivably rotating said drawing wheel to generate in the wire substantially the entire tension required for drawing the wire through both the first and second dies.

6. The method of claim 5 which comprises directing liquid coolant flows downstream of the second die so as to surround the wire passing from the second die as it is being wrapped around the drawing wheel.

7. The method of claim 5 wherein the step of directing the wire in a return path from the downstream end of the first die includes directing the wire into engagement with the periphery of an idler wheel so that the movement of the wire along the return path rotates the idler wheel.

8. The method of claim 7 which comprises directing the liquid coolant into contact with the wire while the wire is in engagement with the idler wheel.

* * * * *